US005193370A

United States Patent [19]

Norden

[11] Patent Number: 5,193,370

[45] Date of Patent: Mar. 16, 1993

[54] LOST MOTION DOOR LOCKING MECHANISM

[76] Inventor: Howard P. Norden, 3 Crest Hill Pl., Smithtown, N.Y. 11787

[21] Appl. No.: 860,096

[22] Filed: Mar. 30, 1992

[51] Int. Cl.[5] ..... E05B 9/10

[52] U.S. Cl. ..... 70/120; 70/379 R; 70/DIG. 42; 70/DIG. 60

[58] Field of Search ..... 70/379 R, 379 A, 380, 70/120, DIG. 60, DIG. 42, DIG. 23; 292/36, DIG. 62

[56] References Cited

U.S. PATENT DOCUMENTS

| | | | |
|---|---|---|---|
| 1,053,527 | 2/1913 | Miller | 70/DIG. 42 X |
| 1,159,635 | 11/1915 | Wolfe et al. | 70/DIG. 42 X |
| 1,505,865 | 8/1924 | Costa | 70/DIG. 42 X |
| 3,089,330 | 5/1963 | Kerr | 70/DIG. 42 X |
| 3,991,595 | 11/1976 | Bahry et al. | 292/36 X |
| 4,100,774 | 7/1978 | Solovieff et al. | 70/DIG. 60 X |
| 4,799,718 | 1/1989 | Ing | 292/36 |
| 4,984,832 | 1/1991 | Canepa | 292/36 |
| 5,010,747 | 4/1991 | Norden, Jr. | 70/94 |

FOREIGN PATENT DOCUMENTS

| | | | |
|---|---|---|---|
| 302906 | 1/1918 | Fed. Rep. of Germany | 70/DIG. 60 |

*Primary Examiner*—Lloyd A. Gall
*Attorney, Agent, or Firm*—Galgano & Belkin

[57] ABSTRACT

A door locking mechanism for a door assembly of the type having a door frame and a door mounted for pivotable movement between an opened and closed position with respect to the door frame, includes key-operated cylinder locks mountable on opposite sides of the door, the cylinder locks each having a tailpiece rotatable between a locking and unlocking position via key operation thereof. A bolt is mountable on the door and frame for locking the door in the frame when the door is in its closed position, the bolt being reciprocably movable between a locking and unlocking position. A lever is coupled to the bolt for reciprocably moving the bolt between the locking and unlocking positions thereof. A tumbler assembly includes a generally cylindrical central tumbler coupled to the lever which is reversely rotatable to effect movement of the lever between its locking and unlocking positions, and a pair of stub shafts are independently mounted for free limited rotation in opposite ends of the central tumbler, each of which is coupled to a tailpiece of one of the cylinder locks. Male-female interlock elements are associated with the central tumbler and stub shafts to permit the stub shafts to rotate the central tumbler to, in turn, effect movement of the lever. The stub shafts, in turn, are rotated independently and alternatively of one another via the tailpiece of the cylinder lock coupled thereto upon key operation thereof, whereby the door may be unlocked and locked independently via either cylinder lock without disturbing the position or causing movement of the other cylinder lock.

3 Claims, 2 Drawing Sheets

FIG. 5
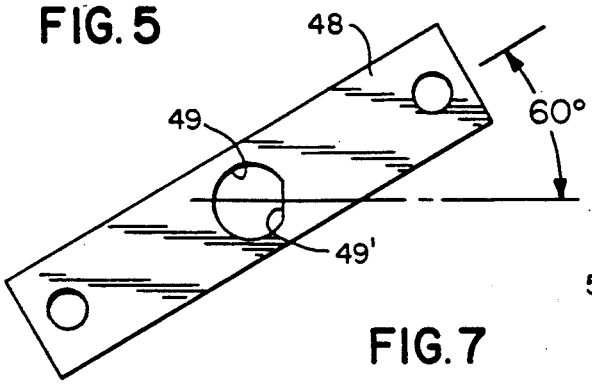
FIG. 6
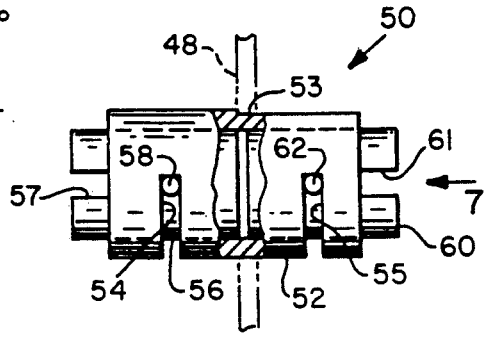
FIG. 7
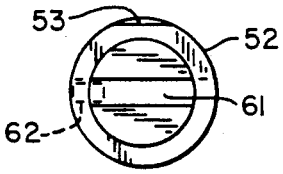
FIG. 9
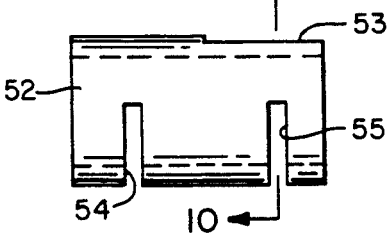
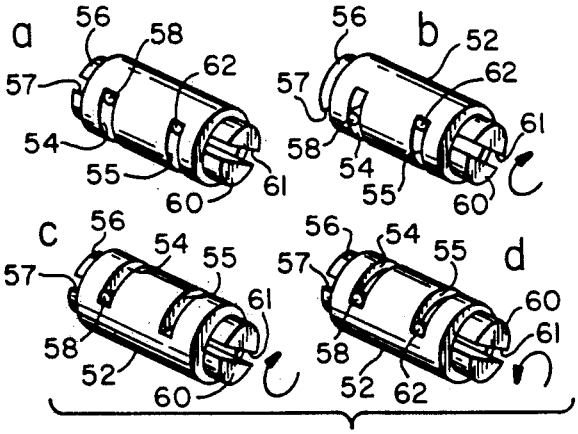
FIG. 8
FIG. 10
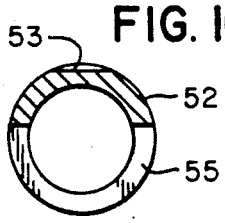
FIG. 12
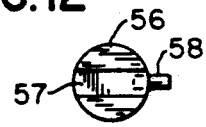
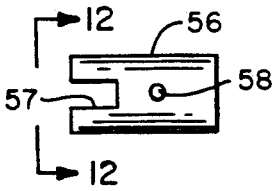
FIG. 11
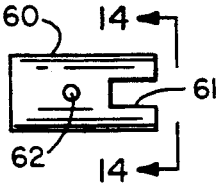
FIG. 13
FIG. 14
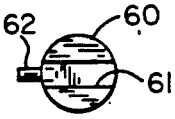

LOST MOTION DOOR LOCKING MECHANISM

BACKGROUND OF THE INVENTION

This invention relates to a door locking mechanism and, more particularly, to a door locking mechanism for use on either an inwardly or outwardly opening door which can be independently locked and unlocked from both the inside and outside thereof.

Commercial establishments and many residential buildings in urban areas require door locking mechanisms with improved ability to withstand attempts at unlawful entry. This is particularly true in public places such as subways and the like where it is necessary to have entry and exit doors which can be independently opened and locked from both sides. In many New York City subways today, for example, in order to lock the swinging entry/exit doors, they currently simply use heavy chains and a single padlock to secure the door. This is obviously an inconvenient and cumbersome system.

In my U.S. Pat. No. 5,010,747 (the subject matter of which is incorporated herein), I disclose a door locking mechanism which locks both side edges of the door simultaneously, can be used with both inwardly and outwardly opening doors, and which can be locked and unlocked via a cylinder lock on the outside of the door. However, on the inside of the door, the mechanism is actuated by a knob. This would be unsuitable for use in public access places such as subways wherein the entry doors typically consist of open vertical bars, as a result of which it would be easy for one who wished to unlawfully enter through the door to simply pass his hand through the door and turn the knob to unlock the lock and open the door.

SUMMARY OF THE INVENTION

Accordingly, it is an object of the present invention to fulfill the need described above by providing a door locking mechanism which locks both side edges of the door simultaneously, can be used with both inwardly and outwardly opening doors, is economical in construction, trouble-free in operation, and can be locked and unlocked from both sides of the door.

It is a further object of the present invention to provide such a novel door locking mechanism which is relatively simple in construction and is readily adaptable and mountable on a variety of either inwardly or outwardly opening doors and which is especially intended for use on vertically barred doors for subways and the like.

Certain of the foregoing and related objects of the invention are readily attained in a door locking mechanism embodying the present invention for a door assembly of the type having a door frame and a door mounted for pivotable movement between an opened and closed position with respect to the door frame, which includes key-operated cylinder lock means mountable on opposite sides of the door. The cylinder lock means each have a tailpiece rotatable between a locking and unlocking position via key operation of the lock means. Bolt means are mountable on the door and frame for locking the door in the frame when the door is in its closed position. The bolt means are reciprocably movable between a locking and unlocking position and lever means are coupled to the bolt means for reciprocably moving the bolt means between the locking and unlocking positions thereof. A tumbler assembly includes a generally cylindrical central tumbler coupled to the lever means which is reversely rotatable to effect movement of the lever means between the locking and unlocking positions thereof. A pair of stub shafts are independently mounted for free limited rotation in opposite ends of the central tumbler, and are each coupled to a tailpiece of one of the cylinder lock means. Male-female interlock means are associated with the central tumbler and stub shafts to permit the stub shafts to rotate the central tumbler to, in turn, effect movement of the lever. The stub-shafts are, in turn, being rotated independently and alternatively of one another via the tailpiece of the cylinder lock means coupled thereto upon key operation thereof. As a result, the door may be unlocked and locked independently via either cylinder lock mean without disturbing the position or causing movement of the other cylinder lock means.

Most advantageously, the male-female interlock means comprises pin and slot means which includes a pair of parallel, circumferentially-extending slots formed in the central tumbler and a pair of pins, each of which is mounted on one of the stub shafts and is received in one of the slots. Most desirably, the slots extend approximately 190 degrees over the circumference of the central tumbler. Preferably, the stub shafts each have a slotted end extending outwardly from said central tumbler which is configured an dimensioned to receive the tailpiece of the cylinder lock means.

In a particularly preferred embodiment of the invention, the lever means comprises a lever arm mounted on the central tumbler for pivotable movement and the bolt mean comprises first and second bolts, means for supporting for slidable movement in a straight line the first bolt adjacent one edge of said door, and means for supporting for slidable movement in a straight line the second bolt adjacent an opposite edge of said door, with both of the aforesaid straight lines being aligned with each other so that the aforesaid bolts slide in opposite directions along the same straight line without any rotation with respect to said straight line. Also provided are connecting means which in response to the rotation of said lever arm in one direction cause the bolts to slide away from each other, and in response to the rotation of said lever arm in the opposite direction, cause the bolts to move toward each other, and retainer means mounted on the frame to lock the door when the lever arm is rotated in the one direction causing the bolts to engage the retainer means and to unlock the door when the lever arm is rotated in the opposite direction causing the bolts to become disengaged from the retainer means.

Other objects and advantages of the present invention will hereinafter become obvious from the following description of a preferred embodiment of this invention.

BRIEF DESCRIPTION OF THE DRAWING

In the drawings, wherein similar reference numerals denote similar elements throughout the various views:

FIG. 5 is an enlarged view of the lever arm;

FIG. 6 is a side elevational view, in part section, of the door lock tumbler assembly;

FIG. 7 is an end view taken along arrow 7 in FIG. 6;

FIG. 8*a–d* shows the movement of the tumbler assembly upon opening of the lock;

FIG. 9 is a side elevational view of the central tumbler;

FIG. 10 is a sectional view taken along line 10—10 of FIG. 9;

FIG. 11 is a side elevational view of one of the stub shaft mounted in the central tumbler;

FIG. 12 is an end view taken along arrows 12 in FIG. 11;

FIG. 13 is a side elevational view of the opposite stub shaft mounted in the central tumbler; and FIG. 14 is an end view taken in the direction of arrows 14 in FIG. 13.

DETAILED DESCRIPTION OF THE PREFERRED AND ILLUSTRATED EMBODIMENT

Figure 1:
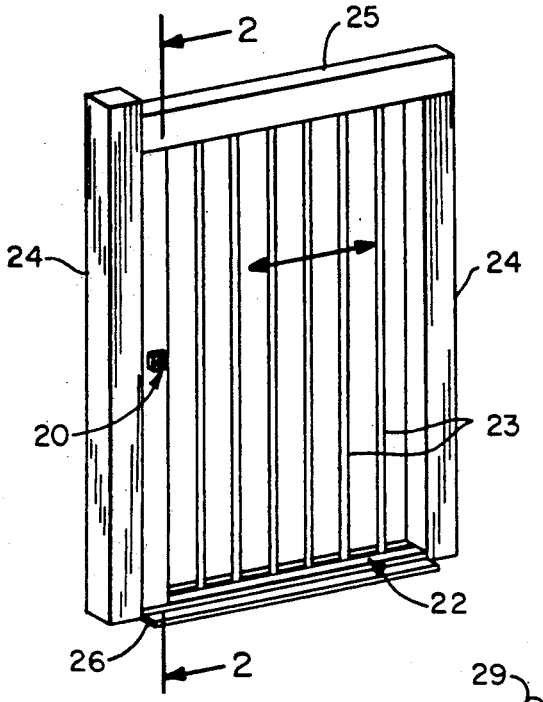
FIG. 1 is an isometric view of the door locking mechanism embodying the present invention operatively installed on a vertically barred entry door.

Referring now in detail to the drawings and in particular FIG. 1 thereof, therein illustrated is a novel door locking mechanism 20 embodying the present invention for use with a door 22 composed of vertical bars 23 hung in conventional fashion in a door frame 24 for either inward or outward swinging movement. The door and jamb construction is of conventional construction well known to those skilled in the art.

Figure 2:
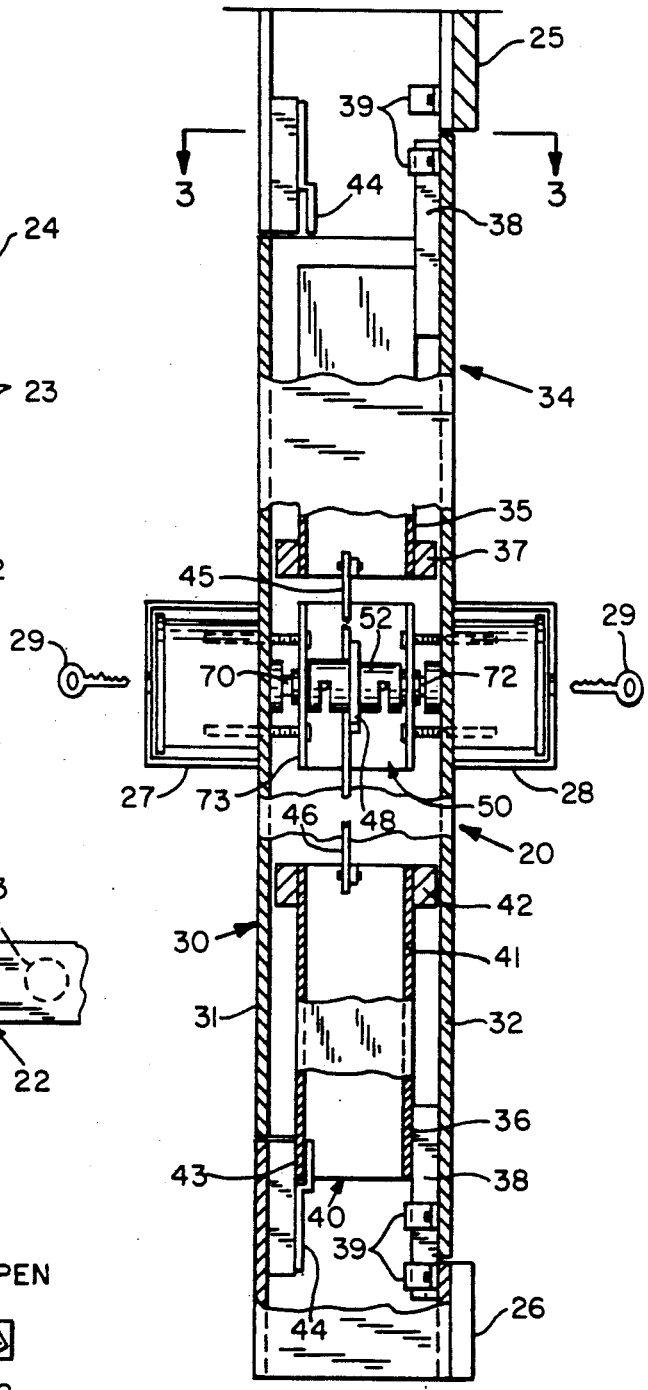
FIG. 2 is an enlarged sectional view taken along line 2—2 of FIG. 1.

As seen best in FIG. 2, door locking mechanism 20 is an elongated vertically-extending protective housing 30 mounted adjacent the side edge of the door which is intended to swing inwardly. Housing 30 is composed of a front cover plate 31 and a rear cover plate 32 enclosing the operating elements of mechanism 20. Door 22 is associated with a double bolt lock which can be locked or unlocked from either side of door 22. Two locking bar assemblies 34, 40, one at the top end and one at the bottom end of door 22 are securable directly into the top and bottom jamb 25, 26 door frame, respectively. The locking assemblies 34, 40 are also fully enclosed within the housing to protect against tampering vandalism and/or personal injury due to carelessness.

Figure 3:
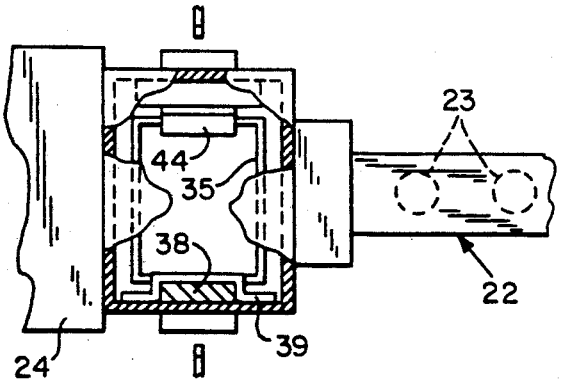
FIG. 3 is an enlarged sectional view taken along line 3—3 of FIG. 2.
Figure 4:
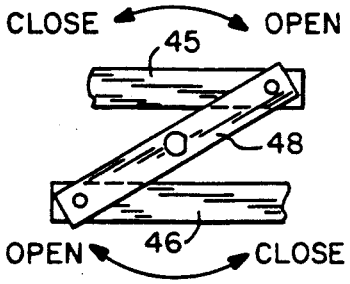
FIG. 4 is a fragmentarily illustrated view of the lever activation of the bolt means.

As seen best in FIGS. 2 and 3, the double bolt assemblies 34, 40 consist of a pair of slidable tubular bars 35, 41, each having a generally rectangular profile which are mounted for vertical reciprocal movement within the protective housing 30 aided via spacers 37, 42. The bars 35, 41 have matching heavy solid steel bars 38 affixed to their front edges which are configured and dimensioned to be slidably received within retaining brackets 39 mounted in the top and bottom edges of the door and door jamb. Similarly, the opposite front edge or lip 43 of the tubular bars 35, 41 is configured and dimensioned to be received within a retaining clip 44 mounted on the rear edge of the top 25 and bottom 26 sections of the door jamb 24. The unlocked or unbolted position of the bolt assemblies 34 is shown in the top portion of FIG. 2 and the locked or bolted position is shown with respect to bolt assembly 40 in the bottom portion of FIG. 2. The bolt assemblies 34, 40 are pivotably connected to pivot link arms 45, 46, respectively, which, in turn, are connected to a pivot lever 48, the operation of which is shown in FIG. 4. As can be appreciated by reciprocating lever arm 48, this will in turn effect either extension or retraction of the bolt bars 35, 41 relative to the door jamb 24 to effect opening or closing of the door 22 as will be discussed in greater detail hereinafter.

As shown in FIG. 2, supported on the front and rear protective covers 31, 32, and on opposite sides of door 22, and coupled via bolts to an internal support 73, are two rim cylinder locks 27, 28 each operated by a key 29, the internal construction of which is well known to those skilled in the art. Each of the cylinder locks 27, 28 has a tailpiece 70, 72 which when the cylinder lock is operated via key 29 will rotate between a locking and unlocking position depending upon the position of the key, as is also well understood in the art. The tailpieces 70, 72 of rim cylinder lock 27, 28 are each coupled to a central tumbler mechanism 50 as discussed in greater detail hereinafter.

Referring now to FIG. 6, therein illustrated is the door tumbler mechanism which includes a generally cylindrical central tumbler 52 which is intended to mount within the central aperture 49 of lever arm 48. Central tumbler 52 is provided with a flat or flat surface 53 which is intended to align with the corresponding flat 49' of aperture 49 so that lever arm 48 and tumbler 52 will move as a unit and be in proper alignment relative to one another (as seen in FIG. 5, lever arm is at a preset angle of 60 degrees). As seen best in FIGS. 9 and 10, tumbler 52 is provided with a pair of parallel, spaced-apart, circumferentially extending slots 54, 55 which extend over approximately 190 degrees of the tumbler circumference, the purpose for which will be explained in greater detail hereinafter.

As seen in FIG. 6, a pair of spaced-apart stub shafts 56, 60 are each mounted for limited free rotation within opposite ends of central tumbler 52. As best seen in FIGS. 11–14, stub shafts 56, 60 each have a slotted end 57, 61 respectively, which is configured and dimensioned to mate with the tailpiece 70, 72 of the rim lock cylinders 27, 28. In addition, each stub shaft 56, 60 is provided with radially-outwardly projecting pin 58, 62 which are slidably received within slots 54 and 55, respectively.

FIGS. 8*a–8d* illustrate a sequence of operation for the central tumbler mechanism 50. FIG. 8*a* shows the initial normal position of the central tumbler 52 and stub shafts 56, 60 with their respective pins 58, 62 at the "top" end of slots 54, 55, respectively. When a key 29 is inserted into rear rim cylinder lock 28 and turned clockwise to open the lock its tailpiece 72 will rotate clockwise and this will cause clockwise rotation of stub shaft 60 and, in turn, central tumbler 52 (see FIG. 8*b*). Upon 180 degrees rotation of key 29, tailpiece 72, stub shaft 60 and central tumbler 52, the tumbler assembly 50 assumes the position in FIG. 8*c*. As can be seen therein, the position of stub shaft 56 has remained unchanged, although its pin 58 abuts the lower end of slot 54. As shown in FIG. 8*d*, upon counter rotation of key 29, approximately 180 degrees to effect removal thereof from rim lock cylinder 28, stub shaft 60 will likewise be counter-rotated 180 degrees due to the counter-rotation of tailpiece 72, but central tumbler 52 does not move, since pin 62 will simply travel through slot 55 of tumbler 52 until it abuts the lower end of slot 55. At this point, it is aligned again with pin 58 of stub shaft 56 which has remained still and unaffected by the operation of stub shaft 60 and tumbler 52.

In the position shown in FIG. 8*d*, the tumbler mechanism is now in position via either key operated lock cylinder 27, 28 to unlock the door. If the front lock cylinder 27 is used, one simply turns the key 29 180 degrees clockwise which, in turn, causes clockwise rotation of tailpiece 70, which in turn causes clockwise rotation of stub shaft 56 (as viewed from the front of the door and which is reversed with respect to that shown in FIG. 8) and central tumbler 52, with the position of stub shaft 60 remaining unaffected. The position reached would be the reverse of that shown in FIG. 8*c*, namely, the central tumbler 52 would be in the position shown in FIG. 8*b* with pin 62 abutting the upper end of slot 55 but pin 58 of stub shaft 56 would be 180 degrees displaced abutting the lower end of slot 54. Upon removal of the key 29 which would require its counterclockwise rotation 180 degrees, the tumbler mechanism would again assume the position shown in FIG. 8*a*.

As can be appreciated from the foregoing, the action provided by the pin-slot arrangement of the tumbler mechanism allows independent operation of both lock cylinders without causing movement of the other. The pin and slot arrangement and independent operation of the two stub shafts via the lock cylinders provides an extremely reliable and effective locking assembly for doors requiring access from both sides.

Various modifications may be made to the invention, as will be apparent to those skilled in the art. For example, either vertical or horizontal, single or double bolt arrangements are possible with the present invention, and various conventional link and lever arm configurations for the double bolt assemblies are, of course, possible. In addition, although the pin and slot arrangement has been found to be extremely effective, it is possible that other male-female tumbler actions might be permissible and/or that these pin and slot arrangements could be reversed on the tumbler and stub shafts, respectively.

Accordingly, while only one embodiment of the present invention has been described and illustrated, it is obvious that many changes and modifications may be made thereunto, without departing from the spirit and scope of the invention.

What is claimed is:

1. A door locking mechanism for a door assembly of the type having a door frame and a door mounted for pivotable movement between an opened and closed position with respect to said door frame, comprising:

a pair of key-operated cylinder lock means mountable on opposite sides of said door, said cylinder lock means each having a tailpiece rotatable between a locking and unlocking position via key operation of said lock means;

bolt means mountable on said door for locking said door in said frame when said door is in said closed position thereof, said bolt means being reciprocably movable between a locking and unlocking position;

lever means coupled to said bolt means for reciprocably moving said bolt means between said locking and unlocking position; and a tumbler assembly including a generally cylindrical central tumbler coupled to said lever means and being reversely rotatable to effect movement of said lever means between said locking and unlocking positions, and a pair of stub shafts independently mounted for free limited rotation in opposite ends of said central tumbler, each of which is coupled to a tailpiece of one of said cylinder lock means and male-female interlock means associated with said central tumbler and stub shafts comprising pin and slot means including a pair of parallel, circumferentially-extending slots formed in said central tumbler and a pair of pins, each of which is mounted on one of said stub shafts and is received in one of said slots, with said slots extending approximately 190 degrees over the circumference of said central tumbler to permit said stub shafts to rotate said central tumbler to, in turn, effect movement of said lever means, said stub-shafts, in turn, being rotated independently and alternatively of one another via said tailpiece of the cylinder lock means coupled thereto upon key operation thereof, whereby said door may be unlocked and locked independently via either cylinder lock means without disturbing the position of or causing movement of the other cylinder lock means.

2. The door locking mechanism of claim 2, wherein said stub shafts each have a slotted end extending outwardly from said central tumbler which is configured and dimensioned to receive said tailpiece of said cylinder lock means.

3. The door locking mechanism of claim 1, wherein said lever means comprises a lever arm mounted on said central tumbler for pivotable movement and said bolt means comprises first and second bolts, means for supporting for slidable movement in a straight line said first bolt adjacent one edge of said door, means for supporting for slidable movement in a straight line said second bolt adjacent an opposite edge of said door, both of the aforesaid straight lines being aligned with each other so that the aforesaid bolts slide in opposite directions along the same straight line without any rotation with respect to said straight line, connecting means in response to the rotation of said lever arm in one direction to cause said bolts to slide away from each other, and in response to the rotation of said lever arm in the opposite direction to cause said bolts to move toward each other, and retainer means mounted on said frame to lock said door when said lever arm is rotated in said one direction causing said bolts to engage said retainer means and to unlock said door when said lever arm is rotated in the opposite direction causing said bolts to become disengaged from said retainer means.

* * * * *